US006796263B2

(12) United States Patent
Meyer

(10) Patent No.: US 6,796,263 B2
(45) Date of Patent: Sep. 28, 2004

(54) WATERCRAFT COVER AND TRAILER SYSTEM

(76) Inventor: Karl R. Meyer, 14217 N. 54 St., Scottsdale, AZ (US) 85254

( * ) Notice: Subject to any disclaimer, the term of this patent is extended or adjusted under 35 U.S.C. 154(b) by 0 days.

(21) Appl. No.: 10/253,326

(22) Filed: Sep. 24, 2002

(65) Prior Publication Data

US 2003/0056709 A1 Mar. 27, 2003

Related U.S. Application Data

(60) Provisional application No. 60/396,701, filed on Jul. 17, 2002, provisional application No. 60/376,246, filed on Apr. 29, 2002, and provisional application No. 60/324,347, filed on Sep. 24, 2001.

(51) Int. Cl.[7] ..... B63B 17/02

(52) U.S. Cl. ..... 114/361; 280/414.1; 296/181.1; 296/100.1; D12/401

(58) Field of Search ..... 296/181.1, 181.2, 296/181.3, 182.1, 100.02, 100.06–100.09, 100.1, 56, 76, 181–182; 114/361, 344; 280/414.1; 150/166; D12/401, 101–105

(56) References Cited

U.S. PATENT DOCUMENTS 2,816,672 A * 12/1957 Facchini ..... 414/534
2,847,136 A * 8/1958 Neff ..... 296/157
2,860,792 A * 11/1958 Nelson et al. ..... 414/535
2,889,945 A * 6/1959 Holsclaw ..... 414/534
3,122,245 A * 2/1964 MacKusick et al. ..... 414/483
D232,817 S * 9/1974 Watson ..... D12/7
4,029,245 A * 6/1977 Berlin ..... 224/523
4,353,111 A * 10/1982 Gallitzendorfer et al. ... 362/496
4,464,092 A * 8/1984 Chambers et al. ..... 414/534
D288,419 S * 2/1987 Read et al. ..... D12/106
4,781,392 A * 11/1988 Cooper ..... 280/414.1
4,875,700 A * 10/1989 Monroe ..... 280/414.1
4,934,302 A * 6/1990 Harper ..... 114/361
4,960,356 A * 10/1990 Wrenn ..... 414/537
4,966,403 A * 10/1990 Nordstrom ..... 296/76
5,002,299 A * 3/1991 Firehammer et al. .... 280/414.1
5,060,963 A * 10/1991 Godbersen ..... 280/414.1
5,119,752 A * 6/1992 Doherty ..... 114/382
5,158,315 A * 10/1992 Godbersen ..... 280/414.1
5,255,933 A * 10/1993 Carrick ..... 280/414.1
5,399,111 A * 3/1995 Kobayashi et al. ..... 440/6
5,584,099 A * 12/1996 Westerdale ..... 16/245

(List continued on next page.)

FOREIGN PATENT DOCUMENTS

JP 05097064 A * 4/1993 ..... B62D/25/12

*Primary Examiner*—S. Joseph Morano
*Assistant Examiner*—Ajay Vasudeva
(74) *Attorney, Agent, or Firm*—Snell & Wilmer L.L.P.

(57) ABSTRACT

The present invention provides systems and methods for a watercraft cover and trailer. In accordance with an exemplary embodiment of the present invention, the watercraft cover includes a top cover and a bottom cover, which mate to enclose a watercraft. The top and bottom covers are connected via a gooseneck gas-actuated style hinge for easy opening and closing of the watercraft cover. Adjustable runner boards mounted to the bottom cover allow for easy entry and exit of the watercraft into and out of the watercraft cover. A ring and strap system allow the watercraft to be secured in the watercraft cover, so that transport is possible. Angled flanges on the top and bottom covers provide for easy entry and exit of the watercraft into and out of the watercraft cover and substantially prevent vibration of the watercraft cover. A hole in the bottom cover allows for access to the watercraft even when the watercraft cover is closed and/or locked. The adjustable runner boards may connect with cleats on a trailer for easy transport of the watercraft and watercraft cover. The cleats are also vertically and horizontally adjustable, so that various watercraft and watercraft covers may be positioned on the trailer for transport.

6 Claims, 9 Drawing Sheets

U.S. PATENT DOCUMENTS 5,788,312 A * 8/1998 Lee ..... 296/76
5,823,559 A * 10/1998 Priesgen et al. ..... 280/414.1
RE36,567 E * 2/2000 Godbersen ..... 280/414.1
6,125,784 A * 10/2000 Rehel et al. ..... 114/361
6,186,379 B1 * 2/2001 Haage et al. ..... 224/42.33
6,367,866 B1 * 4/2002 Moore ..... 296/181
6,460,479 B1 * 10/2002 Lopaz et al. ..... 114/361
2003/0006622 A1 * 1/2003 Baik ..... 296/76

* cited by examiner

WATERCRAFT COVER AND TRAILER SYSTEM

CROSS REFERENCE TO RELATED APPLICATIONS

This application claims priority to, and the benefit of, U.S. Provisional Patent Application Serial No. 60/324,347, entitled "Watercraft Cover" filed Sep. 24, 2001; U.S. Provisional Patent Application Serial No. 60/376,246, entitled "Improved Watercraft Cover Components" filed Apr. 29, 2002; and U.S. Provisional Patent Application Serial No. 60/396,701, entitled "Cover and Cleat System and Method" filed Jul. 17, 2002; the entire contents of which are hereby incorporated by reference.

FIELD OF INVENTION

The present invention relates generally to watercraft covers and related components and, more particularly, to an inverting watercraft cover with gooseneck gas-actuated style hinges and angled flanges and a trailer with adjustable cleats.

BACKGROUND OF THE INVENTION

Watercraft (e.g., personal watercrafts (PWCs)) are typically used for recreation or competition on various types of waterways and oceans. When the PWC is not in use, owners of PWC often use a trailer to transport the PWC to and from various locations and/or to store the PWC. A watercraft cover is often used in association with a trailer to provide an improved means for transporting and storing the watercraft while it is not in use. However, conventional watercraft covers are usually bulky, difficult to transport (either to and from the waterway or during shipping), and minimally adjustable. In addition, such conventional watercraft covers may need additional components (e.g., runners and the like) in order to be properly used with an existing trailer.

In view of the foregoing, a need exists for watercraft covers which may address some of the shortcomings of the conventional watercraft covers.

SUMMARY OF THE INVENTION

The present invention provides systems and methods for the design and construction of a watercraft cover and trailer. In accordance with an exemplary embodiment of the present invention, the watercraft cover includes a top cover and a bottom cover for enclosing a watercraft. The top and bottom covers are connected via a gooseneck gas-actuated style hinge for opening and closing the watercraft cover. A ring and strap system includes one or more D-rings mounted to the bottom cover and a strap for securing the watercraft inside the watercraft cover. Angled flanges on the ends of the top and bottom covers provide for easy entry and exit of the watercraft into and out of the watercraft cover. The angled flanges also provide overall rigidity to the cover and substantially minimize vibration of the watercraft cover. A hole in the bottom cover allows for access to the watercraft even when the watercraft cover is closed and/or locked. Adjustable runner boards mounted on the bottom cover may connect with cleats on a trailer for easy transport of the watercraft and watercraft cover. The cleats are also vertically and horizontally adjustable, so that various watercraft and watercraft covers may be positioned on the trailer for transport.

BRIEF DESCRIPTION OF THE DRAWINGS

Additional aspects of the present invention will become evident upon reviewing the non-limiting embodiments described in the specification and the claims taken in conjunction with the accompanying figures, wherein like numerals designate like elements, and wherein:

DETAILED DESCRIPTION

The present invention is described herein and includes various exemplary embodiments in sufficient detail to enable those skilled in the art to practice the invention, and it should be understood that other embodiments may be realized without departing from the spirit and scope of the invention. Thus, the following detailed description is presented for purposes of illustration only, and not of limitation, and the scope of the invention is defined solely by the appended claims. The particular implementations shown and described herein are illustrative of the invention and its best mode and are not intended to otherwise limit the scope of the present invention in any way.

For brevity, the present invention shall be described in connection with a watercraft cover, a watercraft, and a trailer system; however, the watercraft cover and trailer can be any system for housing and/or transporting one or more watercrafts, air crafts, motor vehicles, recreational equipment, gardening equipment, heavy machinery, and/or the like. Thus, the present invention is not limited to watercraft related covers, trailers, and equipment.

Figure 1:
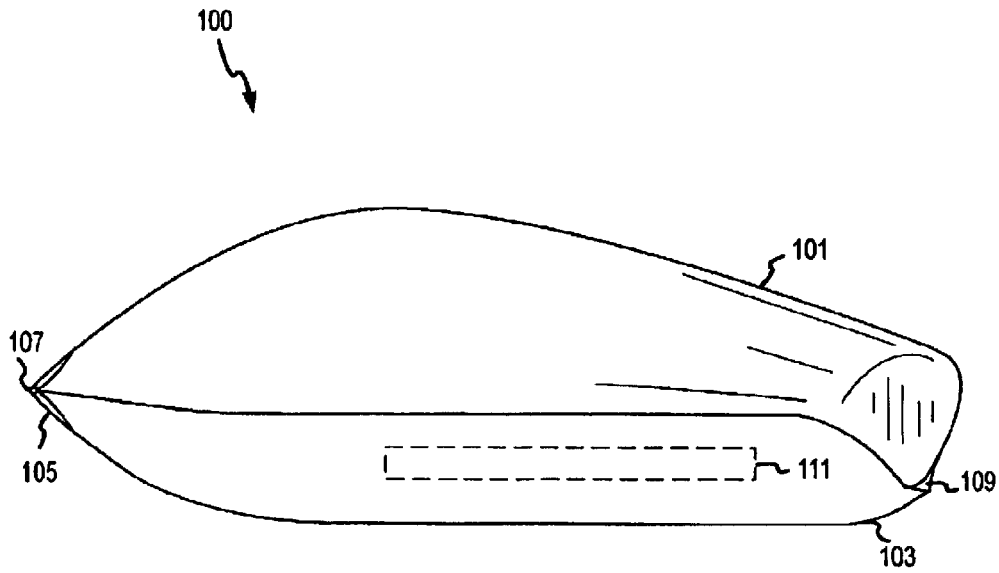
FIG. 1 is a perspective of a watercraft cover in accordance with an exemplary embodiment of the present invention.

FIG. 1 illustrates a watercraft cover 100 in accordance with an exemplary embodiment of the present invention. Watercraft cover 100 includes a top cover 101 and a bottom cover 103 for housing and/or enclosing a watercraft (e.g., a personal watercraft (PWC)). As described above, the watercraft can be any device, such as one or more watercrafts, air crafts, motor vehicles, recreational equipment, gardening equipment, heavy machinery, and/or the like. Top cover 101 and bottom cover 103 are permanently or removably mated to each other via a hinge 105 having a pin 107. By rotating top cover 101 upward with pin 107 as the pivot point, watercraft cover 100 may be opened. Pin 107 enables hinge 105 to provide an expanded degree of rotation, for example, at least 180 degrees of rotation of top cover 101. Once partially or completely opened, a PWC, for example, can access and/or be housed within watercraft cover 100.

Watercraft cover 100 does not need to include gas shocks to assist in opening watercraft cover 100, which reduces the cost of watercraft cover 100. Top cover 101 is configured from a lightweight material such as, for example, fiberglass so that it is lighter for easy opening. Top cover 101 and bottom cover 103 can be configured as fully-enclosed fiberglass covers that help protect against most weather, road debris, and vandalism or theft. In such an embodiment, watercraft cover 100 can be configured to weigh about 240 pounds.

In addition, watercraft cover 100 includes a locking mechanism 109 on the rear end of watercraft cover 100. Certain components of locking mechanism 109 are mounted onto top cover 101 and bottom cover 103, so that watercraft cover 100 may be locked to prevent access to the watercraft. For example, locking mechanism 109 may include a top and bottom steel plate 111 (one on each of the top and bottom covers 101 and 103), so that locking mechanism 109 may be locked with a padlock (not shown) or other device.

Watercraft cover 100 is configured to interface with most sizes of existing PWC and trailers. For example, watercraft cover 100 can use the existing runners from a trailer for easy positioning on the trailer. As such, additional runners are not needed, which reduces costs.

Figure 2:
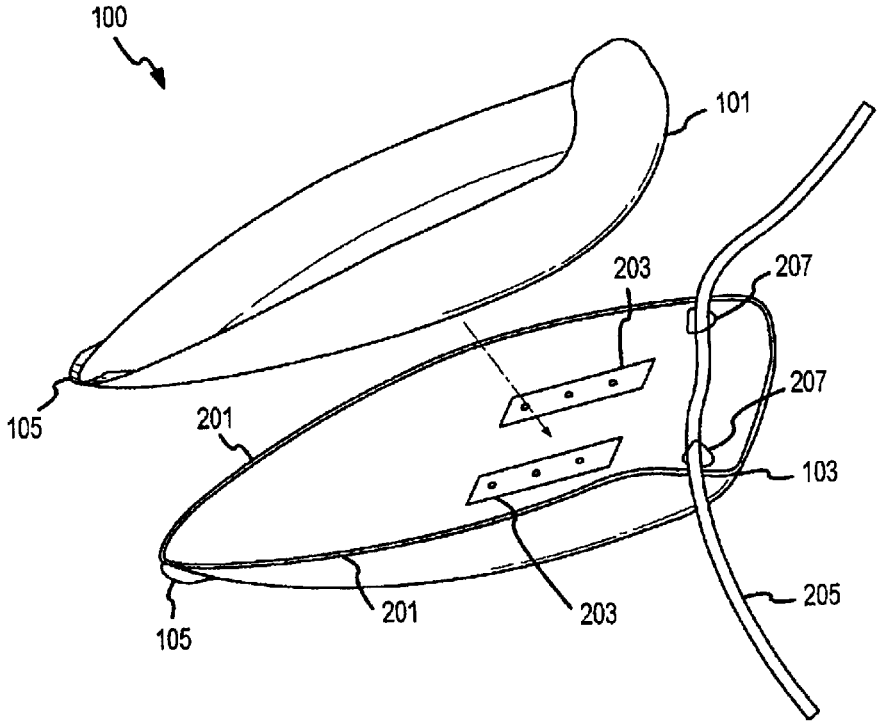
FIG. 2 is a perspective of a watercraft cover in accordance with an exemplary embodiment of the present invention.

FIG. 2 illustrates an alternate embodiment of watercraft cover 100 in accordance with an exemplary embodiment of the present invention. Top cover 101 is configured to be inverted to fit inside bottom cover 103. Inverting top cover 101 includes placing the outside surface of top cover 101 into the inside surface of bottom cover 103. For example, top cover 101 can be configured to be slightly smaller than bottom cover 103, so that it may easily fit in an inverted manner into bottom cover 103. One way to configure top cover 101 to fit in an inverted manner into bottom cover 103 is to substantially copy the shape of bottom cover 103 in an inverted manner, but with measurements that are slightly smaller than bottom cover 103. Configuring top cover 101 and bottom cover 103 to allow for inverted storage reduces space, protects top cover 101 during storage or shipping, and reduces shipping costs.

The surface where top cover 101 and bottom cover 103 meet when watercraft cover 100 is closed includes rub rails 201 to seal watercraft cover 100 and provide protection to top cover 101 upon being inverted and stored in bottom cover 103. One or more runner boards 203 are mounted (e.g., via bolts) onto the inside surface of bottom cover 103. Runner boards 203 may be carpeted or otherwise finished to facilitate easily sliding of the watercraft into watercraft cover 100 and to avoid damaging the watercraft.

Once the watercraft is properly positioned within bottom cover 103, the watercraft may be further secured to bottom cover 103 via one or more straps 205. Strap 205 can be a nylon strap, tie-down rope, and/or the like, for example. Strap 205 may be positioned through one or more rings 207 (e.g., D-rings), which are permanently or movably mounted to bottom cover 103. Rings 207 may be used as anchors to secure the watercraft to bottom cover 103. Strap 205 may be used in anyway convenient to secure the watercraft. For example, rings 207 may anchor strap 205 to bottom cover 103, so that strap 205 may be wrapped (or tied) around the watercraft to properly secure the watercraft to bottom cover 103. Alternatively, strap 205 can be looped under runner boards 203 and wrapped around the seat of the watercraft to secure the watercraft to bottom cover 103.

Figure 3:
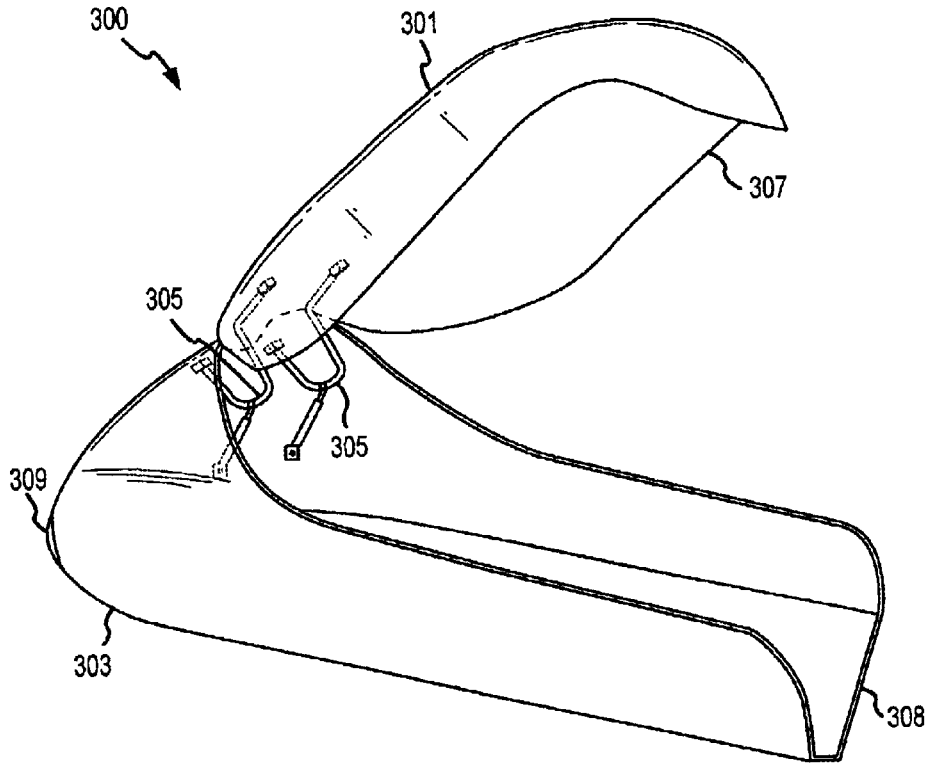
FIG. 3 is a perspective of a watercraft cover in accordance with an exemplary embodiment of the present invention.

FIG. 3 illustrates a watercraft cover 300 in accordance with an exemplary embodiment of the present invention. Watercraft cover 300 includes a top cover 301 and a bottom cover 303 for housing and enclosing the watercraft. Top cover 301 and bottom cover 303 are connected to each other via one or more hinges 305 (e.g., gooseneck gas-actuated style hinges). Upon rotating top cover 301 upward as illustrated in FIG. 3, watercraft cover 300 may be opened. Top cover 301 may be rotated partially or completely, so that the watercraft can be positioned inside watercraft cover 300. Hinges 305 are configured, so that top cover 301 need not be held up by poles, and/or the like. Hinges 305 reduce the risk of top cover 301 falling on a person or the watercraft. Moreover, the wide opening reduces the likelihood of the rider hitting his/her head on the cover when storing the watercraft.

A flange 307 of top cover 301 and a flange 308 of bottom cover 303 are configured to easily allow the watercraft to enter and exit watercraft cover 300. Once the watercraft is housed within watercraft cover 300, top cover 301 may be closed onto bottom cover 303 so that flanges 307 and 308 mate to enclose the watercraft. Flanges 307 and 308 can be configured at various angles to properly mate together (e.g., 45 degree angles). For example, flanges 307 and 308 can have the same angle in one exemplary embodiment. Reducing the angle of flange 308 to about 45 degrees allows for a catch or bottom piece of a locking mechanism (not shown) for watercraft cover 300 to be mounted and concealed inside watercraft cover 300 and still not impede the removal of the watercraft in a dry position. Proper mating of flanges 307 and 308 substantially prevents much the vibrations between top cover 301 and bottom cover 303, e.g., when traveling down the road. When there is too much movement, top cover 301 and bottom cover 303 can chip and scuff one another. A piece of foam rubber can also be added to flange 307 to further reduce vibration.

Figure 9:
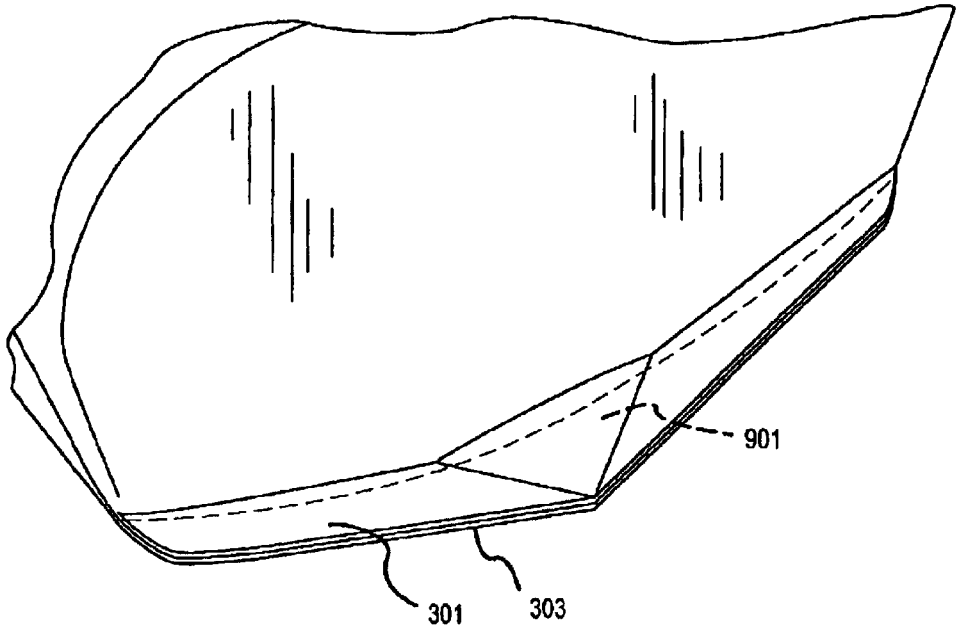
FIG. 9 is a perspective of a pocket of a watercraft cover in accordance with an exemplary embodiment of the present invention.

If flange 307 has an angle of about 45 degrees to match the angle of flange 308 (e.g., on the left and right side of flange 307), then increasing the angle of the center piece of flange 307 creates a pocket inside watercraft cover 300 when top cover 301 and bottom cover 303 are mated. With momentary reference to FIGS. 3 and 9, such a pocket 901 is illustrated in FIG. 9 in accordance with an exemplary e embodiment of the present invention. Closing watercraft cover 300 forms pocket 901 centered no top cover 301 that allows the top or larger portion 903 of the locking mechanism to be mounted. In this manner, the angle of flange 307 varies toward the center of top cover 301 in order to create pocket 901 inside top cover 301 and adequately house the locking mechanism within watercraft cover 300. As such, pocket 901 is created in top cover 301 so as not to have the main lock submerge when watercraft cover 300 is backed into the water when launching. Thus, flanges 307 and 308 virtually eliminate vibration of top cover 301 and bottom cover 303, conceal the locking mechanism, substantially prevents obstruction of the locking mechanism when removing the watercraft, and add overall strength to watercraft cover 300 in both the open and closed positions.

Once the watercraft is enclosed within watercraft cover 300, a hole 309 in bottom cover 303 allows for access inside watercraft cover 300. For example, hole 309 may be configured in the front nose of bottom cover 303 to allow a trailer crank or wench to be used from the trailer. In this manner, watercraft cover 300 need not include a secondary front hatch. The size of hole 309 can be customized by the user of watercraft cover 300 to fit a particular trailer crank or wench. Alternatively, hole 309 can be configured to fit a standardized trailer crank or wench. Watercraft cover 300 fits most sizes of watercrafts, has few additional parts, and is easy to ship.

Figure 4:
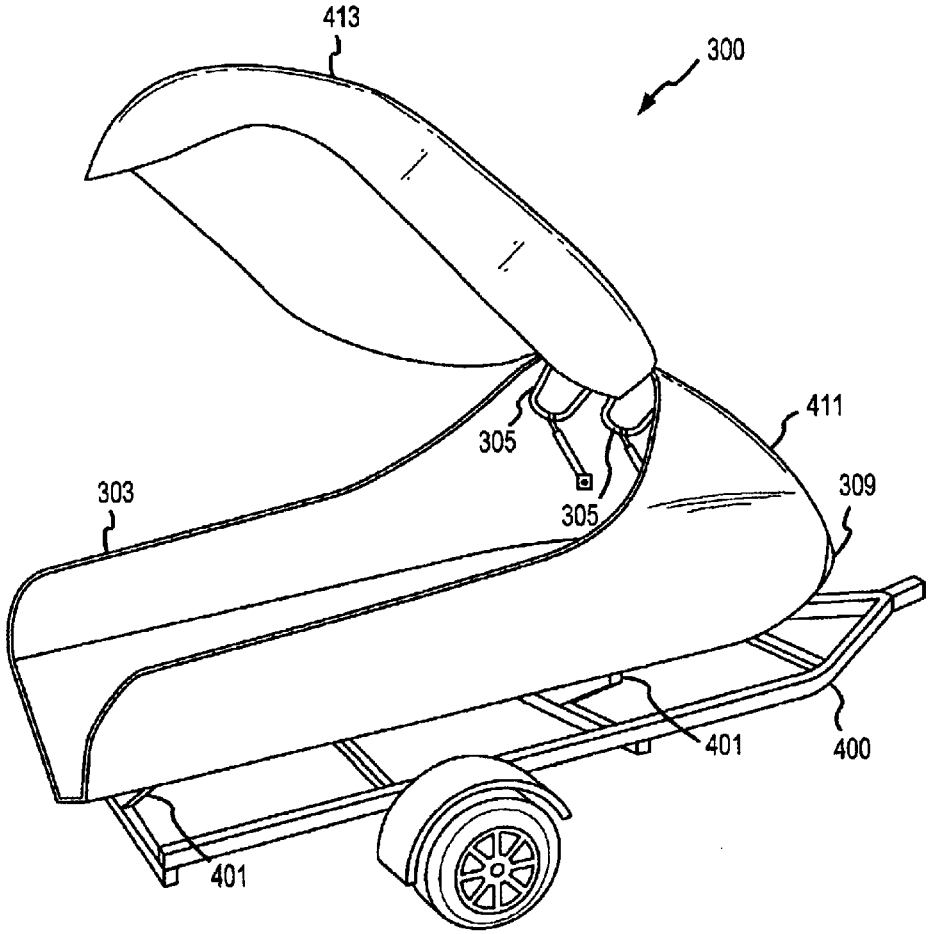
FIG. 4 is a perspective of a watercraft cover positioned on a trailer in accordance with an exemplary embodiment of the present invention.

FIG. 4 illustrates watercraft cover 300 positioned on a trailer 400 in accordance with an exemplary embodiment of the present invention. Watercraft cover 300 includes the ridged shell that protects the watercraft from weather, road debris, and theft. Watercraft cover 300 attaches to any watercraft trailer by means of cleats 401. In one embodiment, watercraft cover 300 includes a ridged material such fiberglass. Watercraft cover 300 can also include a lightweight polymer, a plastic, and/or the like. Watercraft cover 300 includes a hull 411 and a canopy 413. Hull 411 can be shaped with the same pitch as the hull of the watercraft. Watercraft cover 300 can be used in single or tandem trailer application. Watercraft cover 300 is substantially flat on both sides to how side-by-side placement on trailer 400. Canopy 413 is substantially aerodynamic to allow ease in trailering. Watercraft cover 300 is configured so that wood or plastic runner boards (not shown) can attach inside to allow for easy load/unload of the watercraft. Watercraft cover 300 is self-draining and allows for circulation via hole 309. Watercraft cover 300 includes hole 309 in the nose of hull 411 to allow access to the trailer wench. Watercraft cover 300 includes a handle (not shown) on the rear of canopy 413 to assist lifting and closing of canopy 413. Such a handle includes a locking mechanism so that watercraft cover 300 and its contents can be secured.

Trailer 400 includes one or more cleats 401, which substantially maintain the shape of watercraft cover 300. Cleats 401 add rigidity to watercraft cover 300 while watercraft cover 300 is in a stagnant position and in motion. Cleats 401 also allow watercraft cover 300 to be shifted from left to right to accommodate two watercraft covers onto trailer 400 (e.g., a tandem trailer). As such, cleats 401 allow for versatility with multiple trailer bolting applications. Cleats 401 allow watercraft cover 300 to be shifted foreword and backward in order to balance the weight of both the watercraft and watercraft cover 300 over the axle of trailer 400 or to lessen the tong weight of trailer 400. One or more running boards (e.g., running boards 203) (not shown) can be bolted to cleats 401, thereby positioning watercraft cover 300 between cleats 401 and the running boards. Watercraft cover 300 may be positioned down between one or more D-rings (e.g., rings 207) and cleats 401 to allow for tying down of the watercraft inside watercraft cover 300 while traveling. This can substantially prevent trailer 400 from "fishtailing" while moving on a road (e.g., down a road) and makes for easier loading. In addition, cleats 401 help keep the watercraft rigid inside watercraft cover 300 in case of sudden stops or accidents. Accordingly, altering how the watercraft is secured and/or positioned in the trailer is not needed, which can help in limiting liability. As described above, trailer 400 can be configured for storing or transporting one or more watercrafts, air crafts, motor vehicles, recreational equipment, gardening equipment, heavy machinery, and/or the like.

Hole 309 allows for the watercraft to be secured in front and cranked or wenched in when loading. Hole 309 cut into watercraft cover 300 (e.g., a fiberglass cover) allows the crank or wench or wench to maintain its current or original state. This allows the watercraft to be cranked or wenched in the same way with or with out watercraft cover 300 and allows the dynamics of trailer 400 to remain unchanged. Once the watercraft is in place, the cable (not shown) can be released and run back through both hole 309 and a pin in the crank or wench assembly (not shown). Cleats 401 allow one or more D-rings (not shown) to secure the watercraft inside watercraft cover 300, e.g., allowing for the tying down of the watercraft when watercraft cover 300 is closed. In addition, cleats 401 in combination with hole 309 strengthens the overall system by allowing tying down of the watercraft and securing the watercraft to trailer 400 via the crank or wench and cable.

Figure 5:
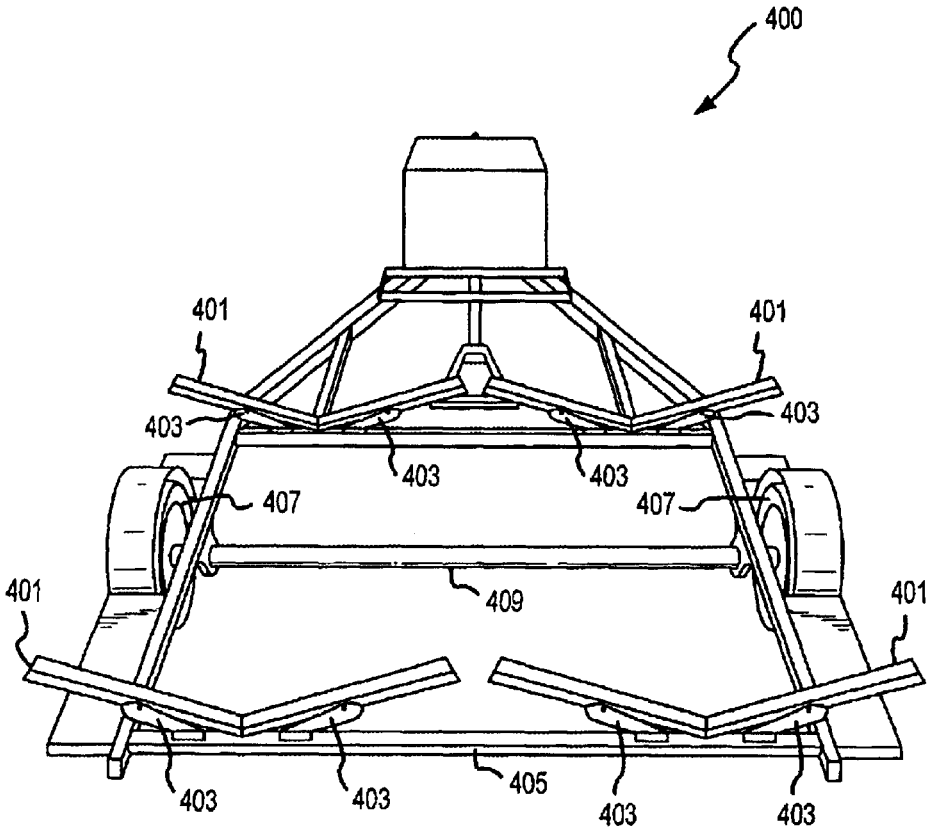
FIG. 5 is a perspective of a trailer in accordance with an exemplary embodiment of the present invention.

FIG. 5 illustrates trailer 400 in accordance with an exemplary embodiment of the present invention. Trailer 400 includes cleats 401, where one or more brackets 403 mount cleats 401 to a frame 405. Wheels 407 along with axle 409 allow for easy mobility of trailer 400. Cleats 401 can be moved in various ways, such as, for example, lifted vertically as well as horizontally to achieve the proper space between a watercraft cover as well as the height to clear the fender of trailer 400 or other mode of transport. Conventionally, trailers are 102 inches from fender to fender or wheel-to-wheel, which is the normal parameter for trailer width. One embodiment of watercraft cover 300 is 51 inches wide with a double application of 102 inches wide. Cleats 401 can also lift and move right or left to allow more than one watercraft cover to fit side-by-side on trailer 400 (e.g., a tandem trailer). By shifting one or more brackets (e.g., risers) 403 to one side or another, there is more room between the watercraft covers. For example, when a watercraft cover is shifted to the left or right, the crank or wench or wench may not center. However, watercraft cover 300 can be configured to shift about 2–3 inches and a flexible strap (e.g., cable) allows for such a shift. In this way, the watercraft can still crank or wench into watercraft cover 300 in the same manner.

In one embodiment, cleats 401 are angled pieces of steel bent in the center to accommodate the pitch of the hull of trailer 400. Cleats 401 can be stainless steel, powder coated stainless steel, aluminum, metals (e.g., non-corrosive metals), and/or the like. Using an angled piece of steel helps keep the sides of watercraft cover 300 substantially straight and ridged while opening and closing top cover 301. As such, the hull of trailer 400 maintains at a desired angle, minimizing watercraft cover 300 (e.g., made of fiberglass) from substantially flexing or warping. In this way, watercraft cover 300 can be made thinner and lighter, which is desirable for gross vehicle weight (GVW) of all trailers and reduced material costs for production.

In one embodiment, two angled cleats 401 on the front and back of trailer 400 may have a pitch that is set for the angle of the cover which is predetermined from the mold or the cleats may have two different pitches. With different pitches, if the pitch at the front of the watercraft cover is different from the pitch at the back of the watercraft cover, trailer 400 can accommodate this difference via the adjustable cleats 401. The watercraft typically has a pitch or dead-rise in the front of 25 degrees. The back of the watercraft typically has a 23 degree pitch. Two or more cleats 401 can have the same angle if desired. By molding watercraft cover 300 relative to the watercraft, the runner boards (or bunks) provide enhanced support. The runner boards are reattached to watercraft cover 300 and also mirror the angle of cleats 401 bolted to trailer 400.

By using the capabilities of cleats 401, horizontal movement, vertical movement, and forward and backward movement of watercraft cover 300 are possible. Cleats 401 allow for standardization of using watercraft cover 300 on most trailers. Other advantages include versatile watercraft placement, proper weight distribution, easy watercraft cover placement, easy crank or wench or box placement, many watercraft trailer applications, lower cost of materials for construction, lowers total weight of overall watercraft cover, increases overall trailer strength and rigidity, interior tie-down capability in any position, and/or the like.

Figure 6:
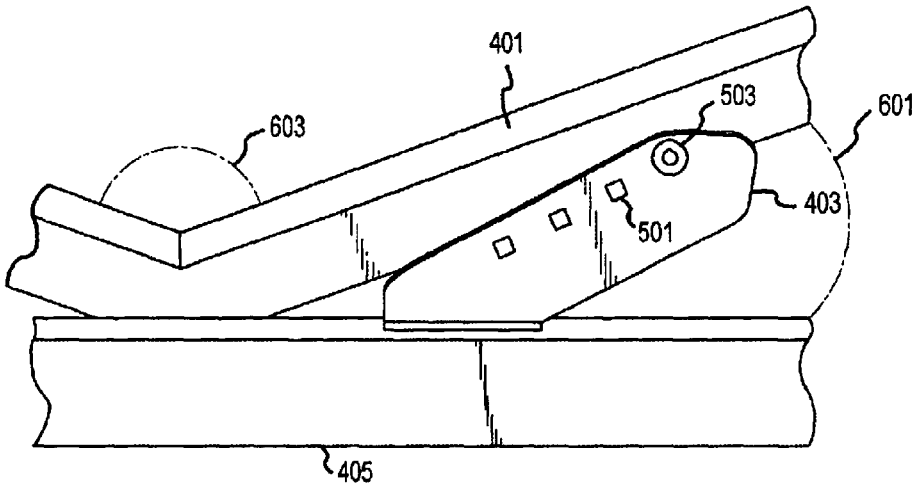
FIG. 6 is a perspective of a cleat in accordance with an exemplary embodiment of the present invention.

FIG. 6 illustrates bracket 403 connecting cleat 401 to frame 405 in accordance with an exemplary embodiment of the present invention. In one embodiment, bracket 403 can be mounted to frame 405 as an anchor. Bracket 403 includes one or more holes 501, which may be used with a fixture 503 (e.g., a bolt, screw, or the like) to connect cleat 401 to bracket 403.

In this manner, a 90 degree angle bent downward enables the mounting or bolting of cleat 401 to frame 405 of trailer 400. This allows for the bolting and the shifting of the cleat 401 to the right or left. In this way, two watercraft covers can sit side-by-side on trailer 400. For example, this meets one state law requirement of having 102 inches or 8 feet 6 inches in total width. The angle on cleat 401 can be cut out of sheet-steel, for example, before the bending which helps watercraft cover 300 (e.g., a fiberglass shell) keep its shape. This also adds rigidity while watercraft cover 300 is traveling or open. In one embodiment, cleat 401 uses a stamped piece of metal bent at two angles. A cover angle 603 is used for mounting watercraft cover 300 to the angled piece of steel and mounting one or more rings (e.g., D-rings) to cleat 401. Cover angle 603 can be 90 degrees and supports the weight of watercraft cover 300 on both sides. The piece of metal with cover angle 603 can support watercraft cover 300 and also be used as a bolting platform for watercraft cover 300.

A second angle, a leg 601 (or raised piece of angle) of cleat 401, is configured to fasten watercraft cover 300 to trailer 400. This raised piece of angle is also referred to as the "trailer angle". Watercraft cover 300 can move or shift to the left or right to accommodate two covers or a large wheel-well. Leg's 601 capability can be shifted vertically or horizontally (or any other direction) on any individual trailer. Leg 601 also has the ability to be drilled in any position while handling the weight load. Leg 601 strengthens trailer 400 by tying at least two of brackets 403 together.

Watercraft cover 300 is fastened to cleat 401 with, in one embodiment, bolts that go through not only bottom cover 303, but the runner boards (e.g., wood boards) as well. In one embodiment, watercraft cover 300 is also secured by interior "tie-downs" (e.g., rings 207) that sandwich watercraft cover 300 and the runner boards between the tie-downs and cleat 401. This mounting procedure allows watercraft cover 300 to move forward or backward on trailer 400 to accommodate or correct for fishtailing or weight distribution. The bunks or wood runners can be moved vertically or horizontally (or any other direction) inside watercraft cover 300 to accommodate various types of watercraft. The movement of watercraft cover 300 also accommodates different types of crank or wench hoists and toy boxes on trailers.

Figure 7:
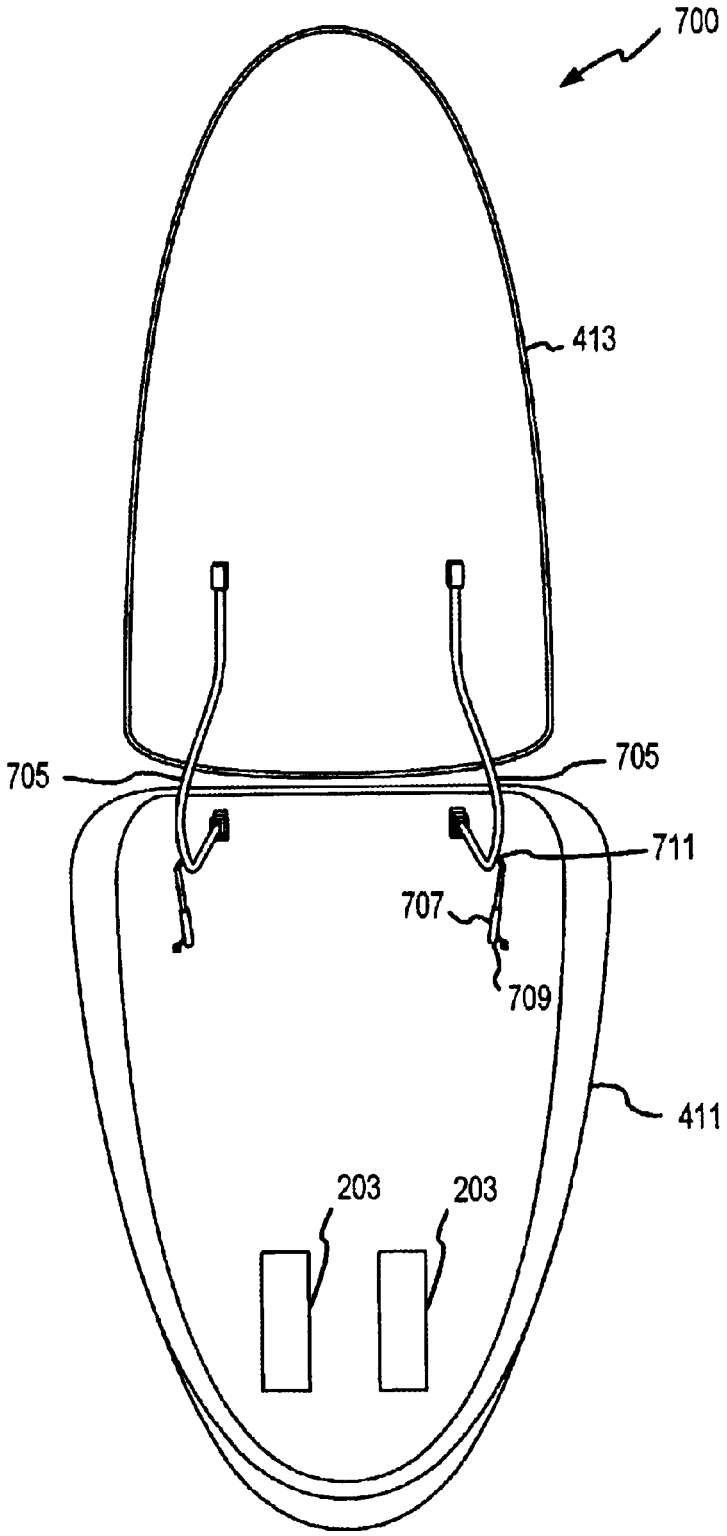
FIG. 7 is a perspective of a hinge/shock system of an open watercraft cover in accordance with an exemplary embodiment of the present invention.

FIG. 7 illustrates a hinge/shock system 700 of watercraft cover 300 in accordance with an exemplary embodiment of the present invention. Canopy 413 lifts up and down by way of hinge/shock system 700. Hinge/shock system 700 includes one or more hinges 705, which in one embodiment is a consolidated gooseneck gas-actuated style hinge that can bend to accommodate many features. A pivot point 711 in relation to a gas shock point of attachment 709 allows for a large amount of leverage and a small amount of force from an attached shock 707. If hinge 705 has too much force applied to it, watercraft cover 300 can begin to disfigure (e.g., bow) which would not allow canopy 413 to close properly onto hull 411. The angles in hinge 705 can be configured to incorporate the shape of watercraft cover 300 and the different types of watercraft that may be placed in watercraft cover 300. Such shapes allow hinge 705 to open and close while the watercraft is in or outside watercraft cover 300. Watercraft obstacles (such as mirrors, handle bars, and console panels) can be accounted for when placing hinge 705 and shock 707 inside watercraft cover 300. In this manner, it is helpful to place hinge 705 and shock 707 deeper into bottom cover 303 to aid in preventing inference between the watercraft and hinge 705 and shock 707. The amount of lift or rise watercraft cover 300 will extend is in relation to the angle or grade of the watercraft ramp (e.g., a boat ramp). The amount of vertical lift lost as watercraft cover 300 is backed down the watercraft ramp is the amount of lift that is to be added to canopy 413. Hinge 705 has enough lift to prevent pinching between canopy 413 and the nose of hull 411 (e.g., where the two parts separate).

The relationship between hinge 705 and shock 707 includes their substantially coordinated operation to allow mobility of canopy 413. The angle of pivot of hinge 705 and shock 707 substantially prevents interference of hinge 705 and shock 707 with the watercraft, straight alignment with shock 707 (e.g., a gas shock) in relation to the shape of watercraft cover 300, and decreases or eliminates interference with the foot placement of the operator when backing the watercraft out of watercraft cover 300. The length of hinge 705 is related to the pivot point, so as to properly attach shock 707 and to reach canopy 413 without contact with the watercraft. The pivot-point affects the depth of setting hinge 705 into watercraft cover 300, substantially preventing pinching when canopy 413 is opened, and shock 707 attachment that creates the lift.

Figure 8:
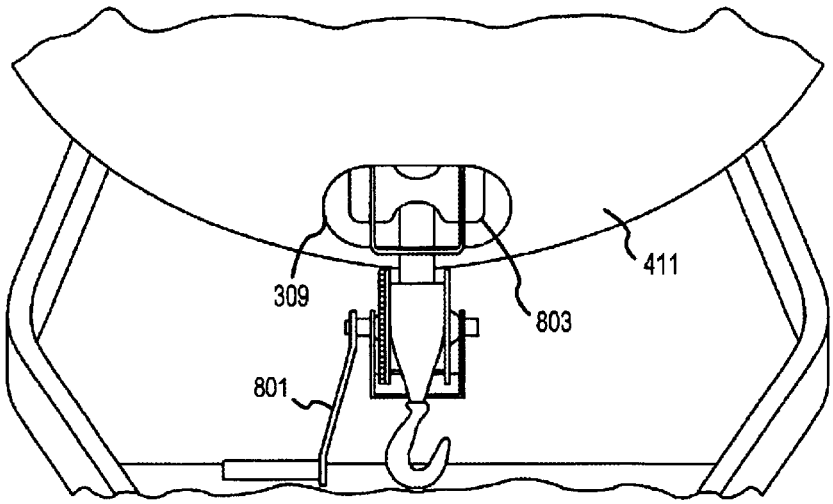
FIG. 8 is a perspective of a hole of a watercraft cover in accordance with an exemplary embodiment of the present invention.

FIG. 8 illustrates hole 309 of watercraft cover 300 in accordance with an exemplary embodiment of the present invention. An outside view of a crank or wench 801 with a ball guide 803 inside to stop the watercraft at an appropriate distance from the inside of hull 411. Accordingly, crank or wench 801 with ball guide 803 can be operated even when top cover 301 and bottom cover 303 enclose the watercraft. Thus, the dynamics of trailer 400 remain substantially unchanged even when top cover 301 and bottom cover 303 enclose the watercraft.

In the foregoing specification, the invention has been described with reference to specific embodiments. Various modifications and changes can be made, however, without departing from the scope of the present invention as set forth in the claims below. The specification and figures are to be regarded in an illustrative manner, rather than a restrictive one, and all such modifications are intended to be included within the scope of present invention. Accordingly, the scope of the invention should be determined by the appended claims and their legal equivalents, rather than by the examples given above. For example, the steps recited in any of the method or process claims may be executed in any order and are not limited to the order presented in the claims.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", "includes", "including", or any other variations thereof, are intended to cover a non-exclusive inclusion, such that a process, method, article, or apparatus that comprises or includes a list of elements does not include only those elements but may include other elements not expressly listed or inherent to such process, method, article, or apparatus. Further, no element described herein is required for the practice of the invention unless expressly described as "essential" or "critical."

What is claimed is:

1. A watercraft cover system, comprising:

a top cover coupled to a bottom cover, wherein the top and bottom covers are configured to mate to enclose a watercraft;

one or more hinge coupling the top and bottom covers, wherein the one or more hinges include gooseneck gas-actuated hinges; and a locking mechanism used to secure the top and bottom covers, and wherein the top and bottom covers each have a flange, wherein the angle of the flange of the top cover varies toward its center in order to create a pocket inside the watercraft cover for adequately housing the locking mechanism.

2. A watercraft cover system, comprising:

a top cover coupled to a bottom cover, wherein the top and bottom covers are configured to mate to enclose a watercraft; and one or more hinges coupling the top and bottom covers, wherein the one or more hinges include gooseneck gas-actuated hinges and the hinges include a pin style hinge for at least 180 degrees of rotation of the top cover.

3. A watercraft cover system, comprising:

a top cover coupled to a bottom cover, wherein the top and bottom covers are configured to mate to enclose a watercraft, wherein at least one of the top and bottom cover include a hole to allow access to the watercraft once the watercraft is enclosed; and one or more hinges coupling the top and bottom cover, wherein the one or more hinges include gooseneck gas-actuated hinges.

4. A watercraft cover system, comprising:

a top cover coupled to a bottom cover, wherein the top and bottom covers are configured to mate to enclose a watercraft;

one or more hinges coupling the top and bottom covers, wherein the one or more hinges include gooseneck gas-actuated hinges; and one or more runner boards or sliding the watercraft into the bottom cover, wherein the runner boards are vertically and horizontally adjustable.

5. A watercraft cover system, comprising:

a top cover coupled to a bottom cover, wherein the top and bottom covers are configured to mate to enclose a watercraft, wherein the top cover is configured to fit in an inverted position into the bottom cover; and one or more hinges coupling the top and bottom covers, wherein the one or more hinges include gooseneck gas-actuated hinges.

6. A watercraft cover and trailer system, comprising:

a top cover coupled to a bottom cover, wherein the top and bottom covers are configured to mate to enclose a watercraft and be positioned onto a trailer;

one or more hinges coupling the top and bottom covers, wherein the one or more hinges include gooseneck gas-actuated hinges;

the trailer including a frame coupling one or more axels to one or more wheels, so that the system is mobile;

one or more cleats for housing at least one of one or more watercraft and one or more watercraft covers, wherein the cleats are coupled to the frame via one or more brackets and the cleats are configured to allow vertical and horizontal adjustment of the cleats.

* * * * *